US007006773B2

(12) United States Patent
Mizuno

(10) Patent No.: US 7,006,773 B2
(45) Date of Patent: Feb. 28, 2006

(54) IMAGE FORMING APPARATUS, IMAGE FORMING METHOD, AND FIXING DEVICE THEREOF

(75) Inventor: Masanaka Mizuno, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 21 days.

(21) Appl. No.: 10/798,373

(22) Filed: Mar. 12, 2004

(65) Prior Publication Data

US 2005/0201771 A1 Sep. 15, 2005

(51) Int. Cl.
*G03G 15/00* (2006.01)

(52) U.S. Cl. ..... 399/37; 399/88

(58) Field of Classification Search ..... 399/88, 399/90, 37, 69–70; 219/469–471, 216, 21
See application file for complete search history.

(56) References Cited

U.S. PATENT DOCUMENTS 4,890,125 A * 12/1989 Egawa et al. ..... 347/137
5,661,550 A * 8/1997 Ko ..... 399/45
6,847,794 B1 * 1/2005 Namura ..... 399/88
2004/0175200 A1 * 9/2004 Namura ..... 399/88

FOREIGN PATENT DOCUMENTS

JP 5-313536 A 11/1993
JP 11-143269 A 5/1999

* cited by examiner

*Primary Examiner*—Diego Gutierrez
*Assistant Examiner*—Tania Courson
(74) *Attorney, Agent, or Firm*—Foley & Lardner LLP

(57) ABSTRACT

The present invention provides an image forming apparatus having a fixing unit in which electric power is supplied from the power supply unit to a heater thereof, and the formed image is fixed by heating the recording medium on which the image has been formed, a detecting unit which detects an electric power consumption of the forming unit and an electric power consumption of the fixing unit, and a control unit which controls the power supply unit so as to increase the electric power consumption of the fixing unit when the electric power consumption of the forming unit detected by the detecting unit is less than or equal to a predetermined amount, and the image forming apparatus increases the electric power consumption of the fixing unit in a case where there is surplus electric power of the entire apparatus.

12 Claims, 4 Drawing Sheets

IMAGE FORMING APPARATUS, IMAGE FORMING METHOD, AND FIXING DEVICE THEREOF

BACKGROUND OF THE INVENTION

Recently, accompanying improvements in the performances of image forming apparatuses such as digital copiers, integrated digital devices having not only a copying function, but also a function as a printer have been developed and popularized. In such an image forming apparatus, the electric power consumption with respect to the respective functions are different from one another.

On the other hand, as a conventional image forming apparatus (Jpn. Pat. Appln. KOKAI Publication No. 5-313536), an image forming apparatus which has a circuit for detecting electric energy consumed at a fixing unit, and in which abnormal heating of the fixing unit, or the like is detected by the electric power detecting circuit, and an electric power consumption is controlled, has been known.

In the same way, as a conventional image forming apparatus (Jpn. Pat. Appln. KOKAI Publication No. 11-143269), an image forming apparatus which has an electric power detecting circuit using variation in impedance due to the heat of a fixing unit, and on the basis of the detected result, determines electric energy by making an electromagnetic induction heating apparatus vary a frequency, has been known. In the conventional image forming apparatus, it is possible to supply a stable fixing temperature without abnormal heating from the electric power detecting circuit and the induction heating apparatus.

However, in these conventional image forming apparatuses, there is no function of taking into account the electric power consumption of the entire apparatus as a digital multifunction device having many functions. Accordingly, there is the problem that the electric power consumption of the entire image forming apparatus must be taken into account, and by further supplying the surplus power in that case to, for example, a fixing device, the temperature of the fixing device must be maintained to be stable and the time for warming-up must be shortened.

BRIEF SUMMARY OF THE INVENTION

One embodiment of an image forming apparatus according to the present invention is an image forming apparatus having a forming unit to which electric power is supplied from a power supply unit, and which forms an image onto a recording medium on the basis of acquired image information, a fixing unit in which electric power is supplied from the power supply unit to a heater thereof, and the formed image is fixed by heating the recording medium on which the image has been formed, a detecting unit which detects an electric power consumption of the forming unit and an electric power consumption of the fixing unit, and a control unit which controls the power supply unit so as to increase the electric power consumption of the fixing unit when the electric power consumption of the forming unit detected by the detecting unit is less than or equal to a predetermined amount.

DETAILED DESCRIPTION OF THE INVENTION

Hereinafter, an image forming apparatus and an electric power control method thereof will be described in detail with reference to the drawings.

<Image Forming Apparatus>

(Configuration of Electric Power Control)

Figure 1:
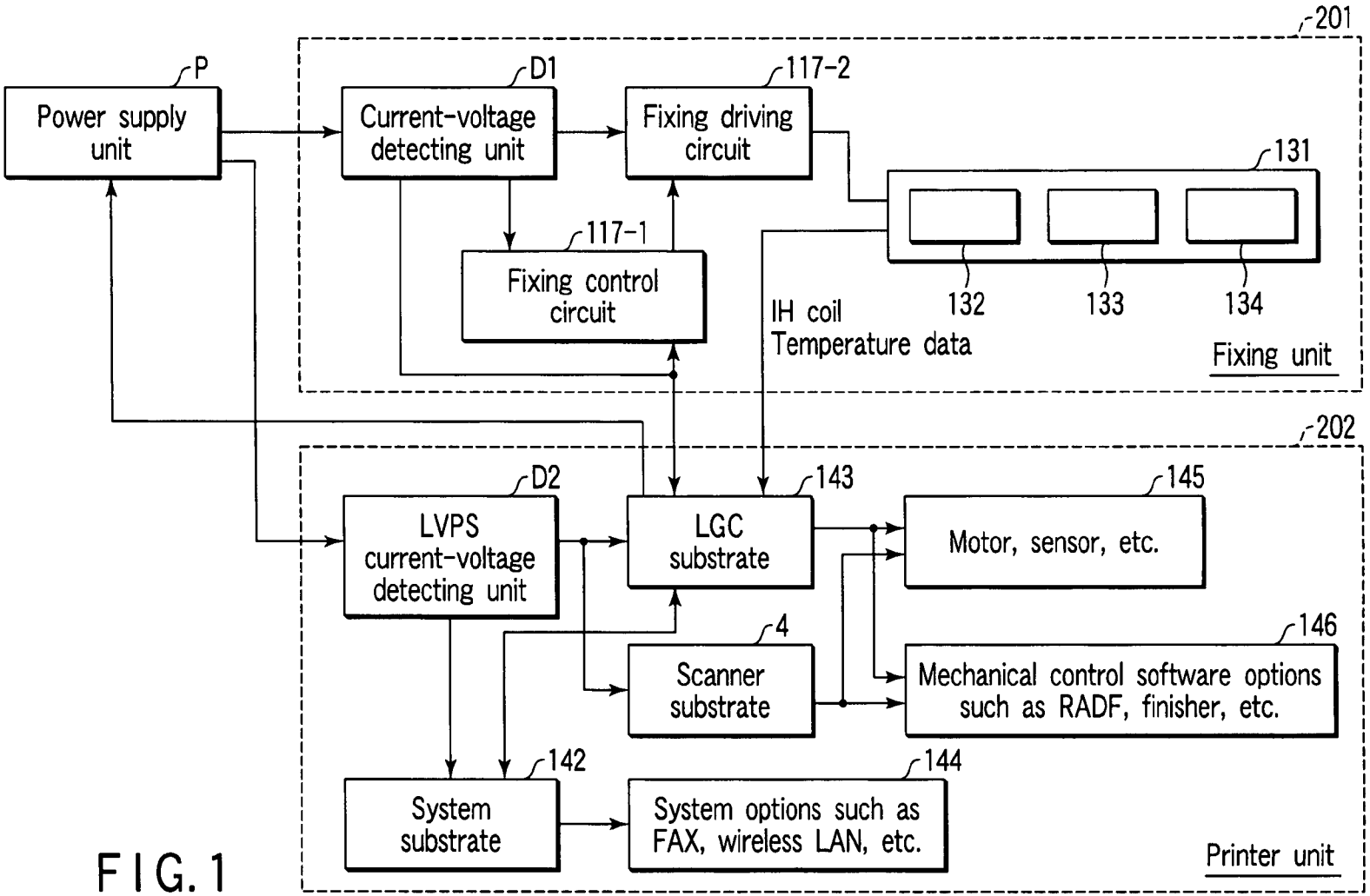
FIG. 1 is a block diagram showing one example of a current-voltage detection of a fixing unit and a printer unit of an image forming apparatus.

First, the configuration of the electric power control of the image forming apparatus will be described with reference to the drawings. FIG. 1 is a block diagram showing one example of the current-voltage detection of a fixing unit and a printer unit of the image forming apparatus. In FIG. 1, a power source from a power supply unit P that supplies electric power (current-voltage) is respectively supplied to a fixing unit 201 and a printer unit 202. Moreover, the fixing unit 201 has a current-voltage detecting unit D1 which detects electric power to be supplied thereto, a fixing control circuit 117-1 to which the current-voltage which passed through the current-voltage detecting unit D1 is supplied, a fixing driving circuit 117-2 connected thereto, and an IH (induction heating) coil (a part of a fixing device unit 60 which will be described later) at the inside of a fixing roller 131 driven by the fixing driving circuit 117-2. The IH coil has side heaters 132 and 134, and a center heater 133. Moreover, although as will be described in detail later, the printer unit 202 has an LVPS current-voltage detecting unit D2 to which electric power is supplied from the power supply unit P, an LGC substrate 143 (corresponding to a main CPU 91, a ROM 92, a RAM 93, an NVM 94, or the like which will be described later in FIG. 3) which is a control unit that receives detection signals from the LVPS current-voltage detecting unit D2 and the current-voltage detecting unit D1, and supplies control signals to the respective units to control the entire operations, a scanner substrate 4 which is connected to the LVPS current-voltage detecting unit D2 and to which electric power is supplied, a system substrate 142, options 144 of the respective systems such as a FAX, a wireless LAN, etc. whose operations are controlled by the system substrate 142, motor, sensor, or the like 145 whose operations are controlled by the scanner substrate 4 and the LGC substrate 143, and respective mechanical control software options 146 such as RADF, a finisher, etc.

(Mechanical Structure)

Figure 2:
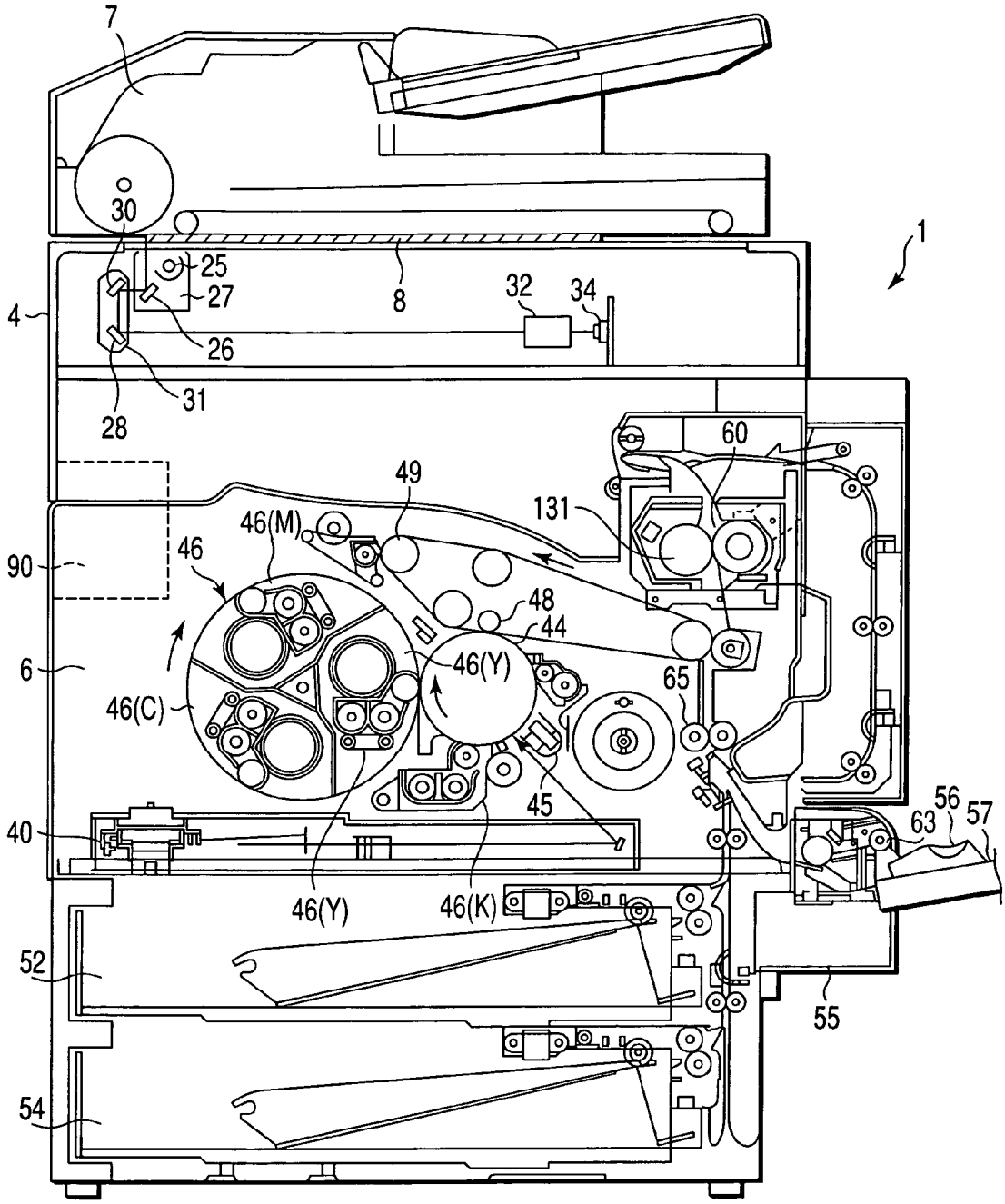
FIG. 2 is a cross sectional view showing one example of a mechanical structure of the image forming apparatus.

Next, one example of the configuration of the image forming apparatus will be described. FIG. 2 is a structural drawing for explanation of an internal structure of the image forming apparatus. This image forming apparatus 1 is configured from the color scanner unit 4 serving as an image reading unit, the printer unit 6, an automatic document feeder (hereinafter, abbreviated as ADF) 7, an operating panel 80 which will be described later, and the like.

The scanner unit 4 has the ADF 7 at the top portion thereof, and there is provided a document platen 8 of transparent glass which is disposed so as to face the ADF 7 in a closed state, and on which a document is set. Below the document platen 8, an exposure lamp 25 that illuminates the document placed on the document platen 8, and a first mirror 26 that concentrates light from the exposure lamp 25 on the document and refracts the reflected light from the document, for example, to the left direction with respect to the drawing, are fixed to a first carriage 27.

The first carriage 27 is disposed so as to be movable in parallel with the document platen 8, and is moved reciprocally below the document platen 8 by a scanning motor (not shown) via a toothed belt (not shown) or the like.

Further, below the document platen 8, a second carriage 28 which is movable in parallel with the document platen 8 is disposed. Second and third mirrors 30 and 31 which successively deflect the reflected light from the document deflected by the first mirror 26 are attached so as to be perpendicular to each other at the second carriage 28. The second carriage 28 is driven so as to be coupled with the first carriage 27 by the toothed belt that drives the first carriage 27, or the like, and is moved in parallel along the document platen 8 at a half-speed of that of the first carriage 27.

Furthermore, below the document platen 8, there are disposed an imaging lens 32 that focuses the reflected light from the third mirror 31 on the second carriage 28, and a CCD (photoelectric conversion element) 34 that receives and photoelectrically converts the reflected light focused by the imaging lens. The imaging lens 32 is disposed so as to be movable via a driving mechanism within the plane including the optical axis of the light deflected by the third mirror 31, and forms the reflected light into an image at a desired magnification due to the image-forming lens 32 itself moving. Further, the CCD 34 photoelectrically converts the incident reflected light, and outputs an electric signal corresponding to the read document.

The printer unit 6, on the other hand, has a laser exposure device 40 operating as latent image forming means. The laser exposure device 40 has a semiconductor laser serving as a light source, a polygon mirror serving as a scanning member which continuously deflects the laser beam radiated from the semiconductor laser, a polygon motor serving as a scanning motor which drives the polygon mirror so as to be rotated at a predetermined number of rotations, and an optical system which deflects the laser beam from the polygon mirror and which guides the deflected laser beam to a photosensitive drum 44 which will be described later.

Further, the printer unit 6 has the freely rotatable photosensitive drum 44 disposed at the substantially center of the apparatus body and serving as an image carrier, and the peripheral surface of the photosensitive drum 44 is exposed by the laser beam from the laser exposure device 40, and a desired electrostatic latent image is provided formed thereon. At the periphery of the photosensitive drum 44, there are arranged an electrifying charger 45 which electrifies the peripheral surface of the photosensitive drum 44 to a predetermined electric charge, a developing device unit 46 which supplies a toner serving as a developer to the electrostatic latent image formed on the peripheral surface of the photosensitive drum 44 to carry out development at a desired image density, and a transfer charger 48 which transfers a toner image formed on the photosensitive drum 44 onto a paper.

At a position to which the paper onto which the toner image has been transferred by the transfer charger 48 is conveyed, the fixing device unit 60 having the fixing roller 131 is disposed. The fixing roller 131 fixes the toner image onto the paper by pressing and heating.

At the lower portion of the apparatus body, an upper stage cassette 52 and a lower stage cassette 54 which can be respectively withdrawn from the apparatus body are disposed in a state of superimposing on each other, a large capacity feeder 55 is provided at the side of these cassettes, and a paper feeding cassette 57 serving as a manual feed tray 56 as well is mounted so as to be freely attachable and detachable above the large capacity feeder 55.

A resist roller pair 65 is provided at the upstream side of the photosensitive drum 44. The resist roller pair 65 corrects an inclination of the ejected copying paper and matches the front end of the toner image on the photosensitive drum 44 with the front end of the copying paper to thereby feed the copying paper to a transfer belt unit 49 at a speed which is the same as a moving speed of the peripheral surface of the photosensitive drum 44.

Figure 3:
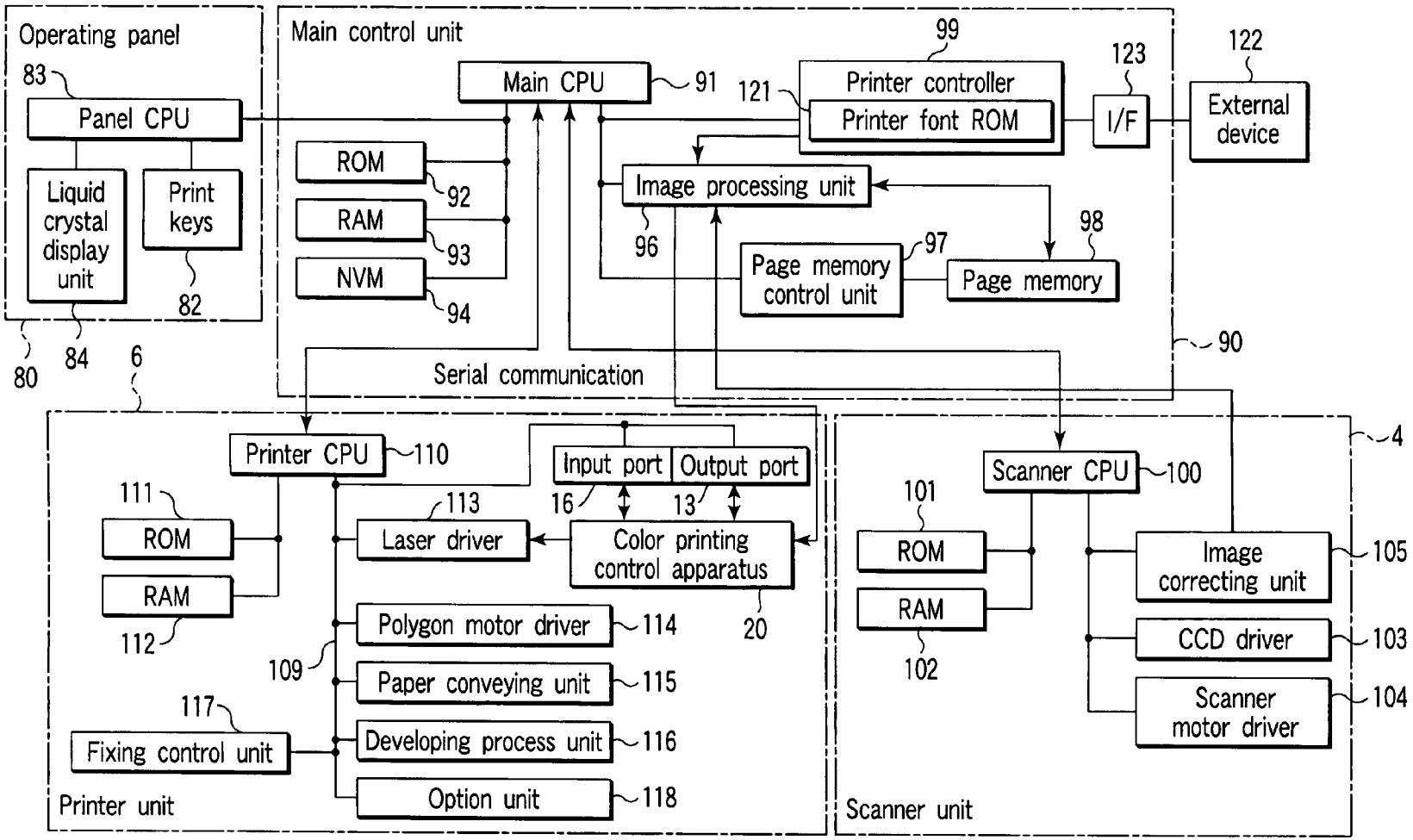
FIG. 3 is a block diagram showing one example of an electrical configuration of the image forming apparatus.

Further, the operating panel 80 for inputting various copying conditions, a copy starting signal for starting copying operation, and the like is provided at the upper portion of the front surface of the apparatus body. The operating panel 80 is configured from, for example, as shown in FIG. 3, print keys 82, a panel CPU 83, and a liquid crystal display unit 84. The print keys 82 are for instructing the copy start. The liquid crystal display unit 84 displays the number of documents or the number of copies, and carries out displaying of a copy magnification or editing, and various operational guidance. A touch panel is provided at the liquid crystal display unit 84.

(Electrical Configuration)

In a block diagram shown in FIG. 3, the image forming apparatus is configured from a control unit formed from three CPUs which are the main CPU (central processing unit) 91 in the main control unit 90, a scanner CPU 100 of the color scanner unit 4, a printer CPU 110 of the color printer unit 6. It is configured such that the main CPU 91 orders operating instructions by carrying out serial communication with the printer CPU 110, and the printer CPU 110 returns a state status to the main CPU 91. Further, it is configured such that the main CPU 91 orders operating instructions by carrying out serial communication with the scanner CPU 100, and the scanner CPU 100 returns a state status to the main CPU 91.

The operating panel 80 is connected to the main CPU 91. Further, the main control unit 90 is configured from the main CPU 91, the ROM 92, the RAM 93, the NVM 94, an image processing unit 96, a page memory control unit 97, a page memory 98, and a printer controller 99.

The main CPU 91 is provided for controlling the entire main control unit 90. In the ROM 92, a control program is stored. The RAM 93 is provided for temporarily storing data.

The NVM (nonvolatile random access memory: nonvolatile RAM) 94 is a nonvolatile memory which is backed up in a battery (not shown), and it is configured such that the data on the NVM 94 is maintained when the power source is turned off.

The page memory control unit 97 is provided for storing image data in the page memory 98, and for reading the image data. The page memory 98 has a region at which image data of a plurality of pages can be stored, and is provided formed such that the data in which the image data from the scanner unit 4 is compressed can be stored for each page. Font data corresponding to print data is stored in a printer font ROM 121.

The printer controller 99 includes the printer font ROM 121, and is provided for expanding the print data from an external device 122 such as a personal computer into image data by using the font data stored in the printer font ROM 121 at a resolution corresponding to the data showing the resolution provided to the print data via an input port 16. Moreover, an external interface 123 performs communications of various types of signals with the external device 122.

The scanner unit 4 is configured from the scanner CPU 100 for controlling the entire scanner unit 4, the ROM 101 in which a control program or the like is stored, the RAM 102 for storing data, a CCD driver 103 for driving the CCD sensor 34, the scanner motor driver 104 for controlling the rotations of a motor which moves the exposure lamp 25 and the mirrors 26, 30, etc., and an image correcting unit 105. The image correcting unit 105 includes a shading correction circuit for correcting irregularities in an A/D conversion circuit which converts an analog signal from the CCD sensor 34 into a digital signal and the CCD 34, or variations in a threshold level with respect to an output signal from the CCD sensor 34 due to an ambient temperature change or the like, and a line memory for temporarily storing the digital signal, on which shading correction has been carried out, from the shading correction circuit.

The printer unit 6 is configured from the printer CPU 110 for controlling the entire printer unit 6, the ROM 111 having a control program or the like stored therein, the RAM 112 for storing data, a laser driver 113 for turning the light-emission (exposure) from a semiconductor laser on-and-off, a polygon motor driver (motor control device) 114 for controlling the rotations of the polygon motor of the laser unit, a paper conveying unit 115 for controlling conveyance of a paper through a conveying path, a developing process unit 116 for carrying out electrifying, development, and transfer by using the electrifying charger 45, the developing device unit 46, and the transfer charger 48, the fixing control unit 117 for controlling the fixing device unit 60, and the option unit 118. The printer unit 6 further includes an output port 13, the input port 16, and an image forming apparatus 20 which is the embodiment of the present invention.

In addition, the image processing unit 96 and the page memory 98 are connected so as to transmit and receive image data, and the image correcting unit 105 and the image processing unit are connected so as to transmit and receive image data. In the same way, the image correcting unit 105 and the color printing control apparatus 20 are connected so as to transmit and receive image data, and similarly, the printer controller 99 and the image processing unit 96 as well are connected so as to transmit and receive image data.

<Electric Energy Control of Image Forming Apparatus>

Figure 4:
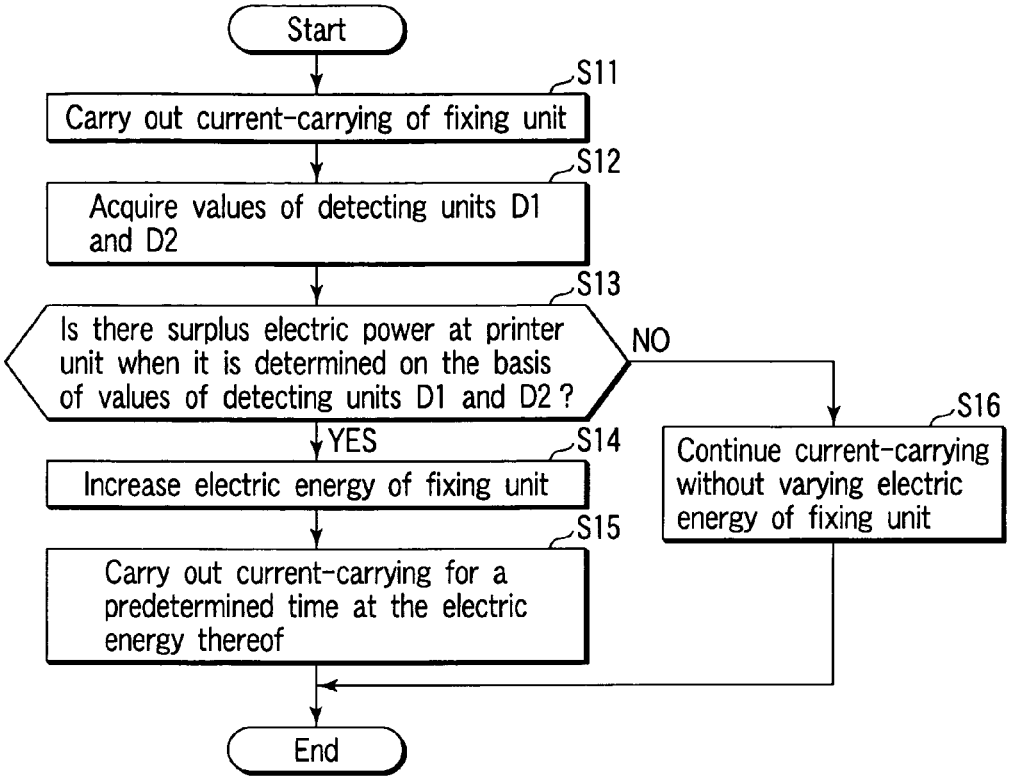
FIG. 4 is a flowchart showing one example of the electric power control of the image forming apparatus.
Figure 5:
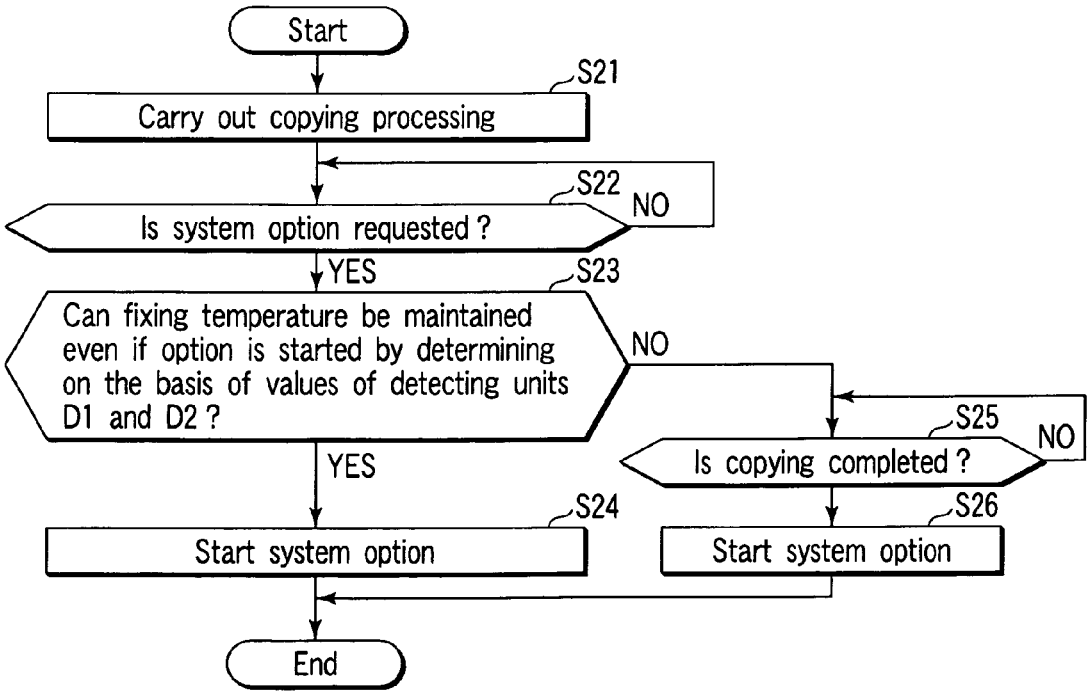
FIG. 5 is a flowchart showing one example of the electric power control including an option of the image forming apparatus.

Next, the electric energy control of the image forming apparatus will be described in detail with reference to flowcharts. Here, the embodiment of the present invention will be described by using an MFP (Multi Function Pedestal) having a function of copying 45 pages per minute, and the printer and FAX functions, and a telephone function, as an example. FIG. 4 is a flowchart showing one example of the electric power control of the image forming apparatus, and FIG. 5 is a flowchart showing one example of the electric power control including an option of the image forming apparatus. This description will be carried out supposing that the electric power consumption of the entire MFP in this embodiment is 1500 W.

(Electric Power Control of Warming-Up)

First, a description will be given for the electric power control at the time of warming-up of the heater of the fixing roller 131 of the fixing unit 201 when the MFP is started. Originally, with respect to the warming-up of the fixing unit 201, maximum electric power within a range of the tolerance of the heater is supplied, whereby a copying operation can be carried out in a short time. With respect to the electric power control of warming-up of the image forming apparatus, not only by detecting the electric power consumption in the fixing unit 201, but also by measuring the electric power consumption of the printer unit 202, a short-time warming-up can be achieved by supplying maximum electric power to the fixing unit 201 while the electric power consumption of the entire image forming apparatus is being detected.

Namely, when the MFP which is the image forming apparatus is started, for example, in accordance with the control operation of the LGC substrate 143, which is the main CPU 91 (FIG. 3) serving as the control unit, the power supply unit P supplies a predetermined electric power to the current-voltage detecting unit D1 of the fixing unit 201, and the LVPS current-voltage detecting unit D2 of the printer unit 202 (S11). Next, the LGC substrate 143 which is the control unit reads out the values of the detecting units D1 and D2, and for example, the detecting unit D1 detects 1000 W, and the detecting unit D2 detects 100 W. At that time, given that the available electric energy is 1500 W, the LGC substrate 143 determines a surplus electric energy as 400 W (S13), and for example, in order to increase the electric energy of the fixing unit 201 from 1000 W to 1400 W, by supplying a control signal to the power supply unit P (or the fixing driving circuit 117-2, or the like), the electric energy is increased. In accordance therewith, a time for warming-up of the fixing unit 201 can be shortened. At that time, it is preferable to carry out current-carrying for a predetermined time, for example, one minute, by the increased electric energy. However, it is possible to vary the electric power consumption in real-time. Further, in step S13, if there is no surplus electric power, the current-carrying is continued without varying the electric energy of the fixing unit (S16).

In this way, in accordance with the present invention, it is possible to provide an image forming apparatus in which, by always monitoring, not only the electric power consumption of only the fixing unit 201, but also the electric power consumption of the entire image forming apparatus, and by shortening a time for warming-up to the maximum, the fixing unit 201 is led to be in the ready state, and prompt copying processing can be carried out.

(Electric Power Control at the Time of Starting System Option During Copying)

Further, next, in the present invention, electric power control at the time when a system option as a multifunction digital copier is started will be described in detail by using the flowchart of FIG. 5. When a function (of copy, FAX, telephone, scanning, or the like) of the option unit 118 is requested during the time when the image forming apparatus is in copying operation (or in image-forming operation) (S21), the LGC substrate 143 recognizes the request of the system option (S22). Then, the LGC substrate 143 refers to the values of the detecting units D1 and D2, and the electric power consumption of the respective functions of the options in which a memory and the like have been set in advance, a current temperature of the fixing roller 131, or the like, and determines whether or not a fixing temperature of the fixing unit 201 can be maintained even if an option is started (S23). When it is determined that the fixing temperature can be maintained, driving signals of the system substrate 142 are supplied to the respective system options 144 in accordance with the control signal from the LGC substrate 143, and the system option is started (S24).

Furthermore, in step S23, when the LGC substrate 143 determines that the fixing temperature of the fixing unit 201 cannot be maintained if the option is started, after it is verified that the copying operation (or, simply, the image forming operation) of the image forming apparatus is completed (S25), the control signal is supplied to the system substrate 142 in order to start the system option (S26).

Namely, one concrete example of the embodiment will be given. When it is clear, for example, from the information stored in the RAM 93 or the like, that there is an incoming message of an optional FAX (or telephone) in a state in which 900 W electric power is consumed in the fixing unit 201 and 600 W electric power is consumed in the printer unit 202 at the time of the copy-mode, and when the incoming message is received, the electric energy of the printer unit increases from 600 W to 700 W. Moreover, when it is clear that the necessary temperature is not reduced even if the electric power consumption of the fixing unit 201 is made to decrease from 900 W to 800 W (S23), after the electric power of the fixing unit is reduced from 900 W to 800 W, the optional FAX (or telephone) is started (S24). Further, in step S23, when the LGC substrate 143 determines that the fixing temperature cannot be maintained if an option is started, the LGC substrate 143 verifies that copying is completed (S25), and the optional FAX (or, telephone or the like) which is the option unit is started after the completion of copying without varying the electric power of the fixing unit 201 (S26).

As described above in detail, in the image forming apparatus, by periodically monitoring the electric power consumption of, not only the fixing unit, but also the entire image forming apparatus, for example, the electric power consumption of the printer unit, a surplus electric energy of the entire image forming apparatus is determined, and the electric power consumption of the fixing unit is increased within the range of the determined surplus electric energy, and prompt copying processing is made to carry out in order to shortening a warming-up time.

Further, in the same way, in accordance with the present invention, there is provided an image forming apparatus which can appropriately distribute electric power within a range of the product standard with respect to an irregular electric power consumption of starting of a system option, or the like, by periodically monitoring the electric powers of the printer unit and the fixing unit.

Note that the description has been provided such that the fixing device unit 60 has the fixing roller 131. However, any configuration suffices provided that it is a configuration in which a toner image is fixed onto a paper by heating in combination of a heater and a film-shaped part or a belt-shaped part, in place of the fixing roller 131, or the like, it may be any configuration.

In accordance with various embodiments described above, the skilled in the art can realize the present invention. However, it is easy for those skilled in the art to further conceive of various modified examples of these embodiments, and the present invention can be applied to various embodiments without inventive ability. Accordingly, the present invention extends over a broad range which does not contradict the disclosed principles and the novel features, and is not limited to the embodiments described above.

What is claimed is:

1. An image forming apparatus comprising:

a forming unit to which electric power is supplied from a power supply unit, and which forms an image onto a recording medium on the basis of acquired image information;

a fixing unit at which electric power is supplied from the power supply unit to a heater thereof, and the formed image is fixed by heating the recording medium on which the image has been formed;

a detecting unit which detects an electric power consumption of the forming unit and an electric power consumption of the fixing unit; and a control unit which controls the power supply unit so as to increase the electric power consumption of the fixing unit when the electric power consumption of the forming unit detected by the detecting unit is less than or equal to a predetermined amount, and determines surplus electric energy by subtracting the electric power consumption of the forming unit and the electric power consumption of the fixing unit from available electric energy of the image forming apparatus, and controls so as to increase the electric power consumption of the fixing unit within a range of the surplus electric energy.

2. An image forming apparatus according to claim 1, wherein the control unit, at the time of increasing the electric power consumption of the fixing unit on the basis of the electric power consumption of the forming unit detected by the detecting unit, increases the electric power consumption of the fixing unit with respect to a predetermined time determined in advance.

3. An image forming apparatus according to claim 1, further comprising:

an option unit which carries out processing different from the image forming processing; and an option control unit which, after receiving a request for processing of the option unit, controls so as to carry out the processing of the option unit when it is determined that power supply to the forming unit and the fixing unit can be sufficiently carried out even if the processing of the option unit is carried out, and so as to carry out the processing of the option unit after the processing of the forming unit is completed when it is determined that the power supply to the forming unit and the fixing unit cannot be sufficiently carried out if the processing of the option unit is carried out.

4. An image forming apparatus according to claim 1, further comprising:

an option unit which carries out processing different from the image forming processing; and an option control unit which, after receiving a request for processing of the option unit, controls so as to carry out the processing of the option unit when it is determined that a fixing temperature of the fixing unit can be maintained even if the processing of the option unit is carried out, and so as to carry out the processing of the option unit after the processing of the forming unit is completed when it is determined that the fixing temperature of the fixing unit cannot be maintained if the processing of the option unit is carried out.

5. An image forming apparatus according to claim 1, wherein the option unit includes at least one of a copying function, a FAX function, a telephone function, and a scanning function.

6. An image forming method, comprising:

respectively detecting an electric power consumption of a forming unit and an electric power consumption of a fixing unit of an image forming apparatus having the forming unit to which electric power is supplied from a power supply unit, and which forms an image onto a recording medium on the basis of acquired image information, and the fixing unit in which electric power is supplied from the power supply unit to a heater thereof, and the formed image is fixed by heating the recording medium on which the image has been formed;

increasing the electric power consumption of the fixing unit when the electric power consumption of the forming unit is less than or equal to a predetermined amount;

determining surplus electric energy by subtracting the electric power consumption of the forming unit and the electric power consumption of the fixing unit from available electric energy of the image forming apparatus; and increasing the electric power consumption of the fixing unit within a range of the surplus electric energy.

7. An image forming method according to claim 6, further comprising controlling, at the time of increasing the electric power consumption of the fixing unit on the basis of the electric power consumption of the forming unit detected by a detecting unit, to increase the electric power consumption of the fixing unit with respect to a predetermined time determined in advance.

8. An image forming method according to claim 6, further comprising:

after receiving a request for processing of an option unit which carries out processing different from the image forming processing, controlling so as to carry out the processing of the option unit when it is determined that power supply to the forming unit and the fixing unit can be sufficiently carried out even if the processing of the option unit is carried out, and so as to carry out the processing of the option unit after the processing of the forming unit is completed when it is determined that the power supply to the forming unit and the fixing unit cannot be sufficiently carried out if the processing of the option unit is carried out.

9. An image forming method according to claim 6, further comprising:

after receiving a request for processing of an option unit which carries out processing different from the image forming processing, controlling so as to carry out the processing of the option unit when it is determined that a fixing temperature of the fixing unit can be maintained even if the processing of the option unit is carried out, and so as to carry out the processing of the option unit after the processing of the forming unit is completed when it is determined that the fixing temperature of the fixing unit cannot be maintained if the processing of the option unit is carried out.

10. An image forming method according to claim 6, wherein the option unit includes at least one of a copying function, a FAX function, a telephone function, and a scanning function.

11. A fixing device comprising:

a fixing unit which carries current to a heater and heats a recording medium on which an image has been formed to thereby fix the formed image;

a detecting unit which respectively detects an electric power consumption with respect to a processing unit to which a power supply unit, supplying electric power to the fixing unit, further supplies electric power, and an electric power consumption of the fixing unit; and a control unit which controls so as to increase the electric power consumption of the fixing unit when the electric power consumption of the processing unit detected by the detecting unit is less than or equal to a predetermined amount, and determines surplus electric energy by subtracting the electric power consumption of the processing unit and the electric power consumption of the fixing unit from available electric energy of the power supply unit, and controls so as to increase the electric power consumption of the fixing unit within a range of the surplus electric energy.

12. A fixing device according to claim 11, wherein, the control unit, at the time of increasing the electric power consumption of the fixing unit on the basis of the electric power consumption of the processing unit detected by the detecting unit, increases the electric power consumption of the fixing unit with respect to a predetermined time determined in advance.

* * * * *